US005918351A

United States Patent [19]

Chou

[11] Patent Number: 5,918,351

[45] Date of Patent: Jul. 6, 1999

[54] STRAP CONNECTORS FOR SWIMMING GOGGLES

[76] Inventor: Terry Chou, No. 12, Hsin Ho Herng Road, Tainan City, Taiwan

[21] Appl. No.: 09/192,424

[22] Filed: Nov. 16, 1998

[51] Int. Cl.[6] ..... A44B 21/00; G02C 3/00

[52] U.S. Cl. ..... 24/265 BC; 24/3.3; 351/156

[58] Field of Search ..... 24/265 BC, 265 DC, 24/3.1, 3.3, 3.13; 35/156, 157

[56] References Cited

U.S. PATENT DOCUMENTS

| | | | |
|---|---|---|---|
| 513,068 | 1/1894 | Anderson | 24/265 BC |
| 5,367,347 | 11/1994 | Wilson et al. | 351/156 |
| 5,377,386 | 1/1995 | Griffith | 24/3.1 |
| 5,541,676 | 7/1996 | Pallat | 24/3.3 |
| 5,642,178 | 6/1997 | Leonardi et al. | 351/156 |

*Primary Examiner*—Victor N. Sakran
*Assistant Examiner*—Phyllis Davis
*Attorney, Agent, or Firm*—Charles E. Baxley, Esq.

[57] ABSTRACT

A strap connector for connecting a strap to a goggle frame includes a first end having a longitudinal slot defined therein and a second end having a transverse slot defined therein. The second end further includes a wedge that tapers toward an end edge thereof, the wedge having a maximum width greater than a width of the longitudinal slot. The strap connector is bent so as to be connected to the goggle frame at a section between the first end thereof and the second end thereof. The wedge is partially received in the longitudinal slot of the strap connector. The strap is wound through the longitudinal slot, the transverse slot, and the longitudinal slot in sequence.

3 Claims, 8 Drawing Sheets

STRAP CONNECTORS FOR SWIMMING GOGGLES

BACKGROUND OF THE INVENTION

1. Field of the Invention

The present invention relates to strap connectors for swimming goggles.

2. Description of the Related Art

FIG. 8 of the drawings illustrates a conventional connector 1' for connecting a strap 2' to a goggle frame 3' (FIG. 3). The connector 1' includes a first end 11' connected to the goggle frame 3' and a second end 12' having two spaced ribs 121' and 122' and a notch 123' defined in an outer edge thereof. In use, an end of the strap 2' is wound through the ribs 121' and 122' in a manner shown in FIG. 9 and then passes the notch 123' to a status shown in FIG. 10 to fix the length of the strap. However, the users are often puzzled about the way of winding the strap 2'. As a result, the winding is time-consuming and difficult to achieve. In addition, the strap 2' is seriously twisted after use, as shown in FIG. 11. The present invention is intended to provide improved strap connectors that mitigate and/or obviate the above problems.

SUMMARY OF THE INVENTION

It is a primary object of the present invention to provide an improved strap connector that allows easy assembly of the strap to the goggle frame.

In accordance with one aspect of the present invention, a strap connector for connecting a strap to a goggle frame comprises a first end having a longitudinal slot defined therein and a second end having a transverse slot defined therein. The second end further includes a wedge that tapers toward an end edge thereof, the wedge having a maximum width greater than a width of the longitudinal slot. The strap connector is bent so as to be connected to the goggle frame at a section between the first end thereof and the second end thereof. The wedge is partially received in the longitudinal slot of the strap connector. The strap is wound through the longitudinal slot, the transverse slot, and the longitudinal slot in sequence.

In accordance with another aspect of the present invention, a strap connector for connecting a strap to a goggle frame comprises a main body and a retaining member. The main body includes a first end connected to the goggle frame and a second having a longitudinal slot. The retaining member includes a first end, a second end with a wedge that tapers toward an end edge thereof, and a transverse slot defined between the first end thereof and the second end thereof. The retaining member is mounted between the first end of the main body and the second end of the main body with the wedge partially received in the longitudinal slot. The wedge has a maximum width greater than a width of the longitudinal slot. The strap is wound through the longitudinal slot, the transverse slot and the longitudinal slot in sequence.

By such arrangements, the strap can be easily and quickly connected to the goggle frame by the strap connectors in accordance with the present invention without serious deformation or twisting of the strap.

The first end of the retaining member is operable to disengage the wedge from the longitudinal slot of the main body to allow adjustment of a length of the strap.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
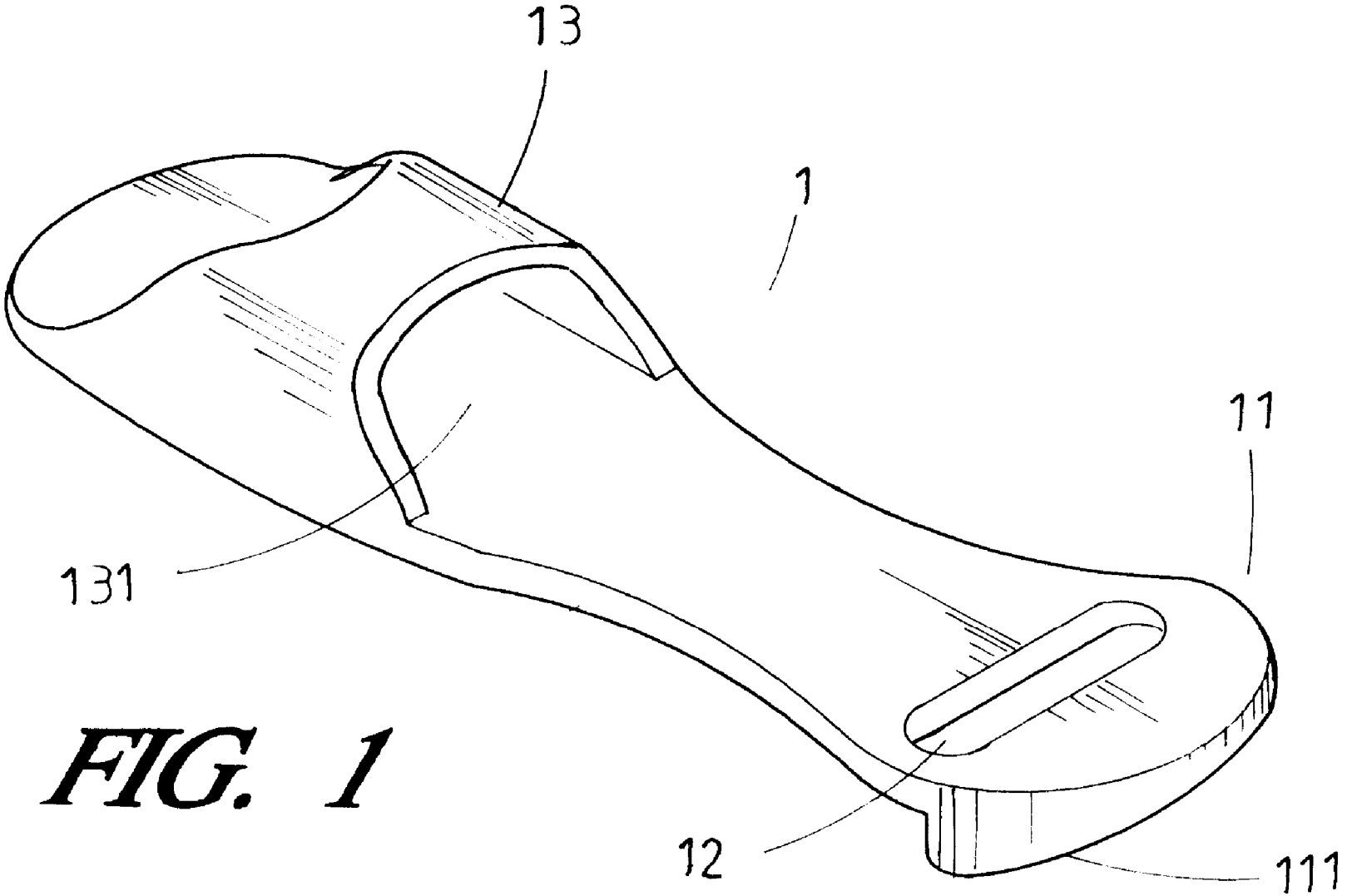
FIG. 1 is a perspective view of a first embodiment of a strap connector in accordance with the present invention.

Referring to the drawings and initially to FIG. 1, a strap connector 1 in accordance with the present invention is made of plastic material and generally includes a first end 13 having a longitudinal slot 131 defined therein and a second end 11 having a transverse slot 12 defined therein, the second end 11 further including a wedge 111 that tapers toward an end edge thereof.

Figure 3:
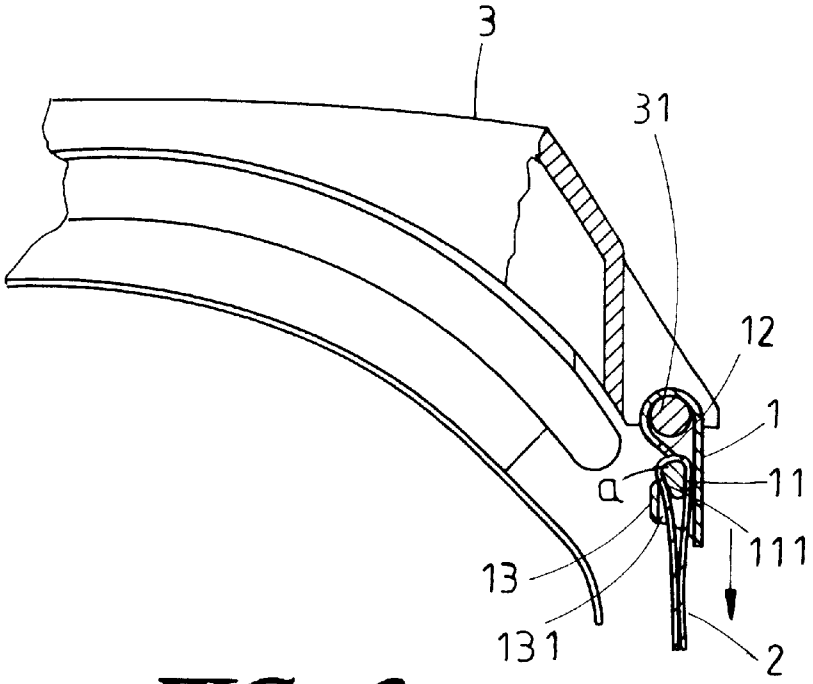
FIG. 3 is a partially sectioned side view similar to FIG. 2, illustrating the status of the strap after assembly.
Figure 2:
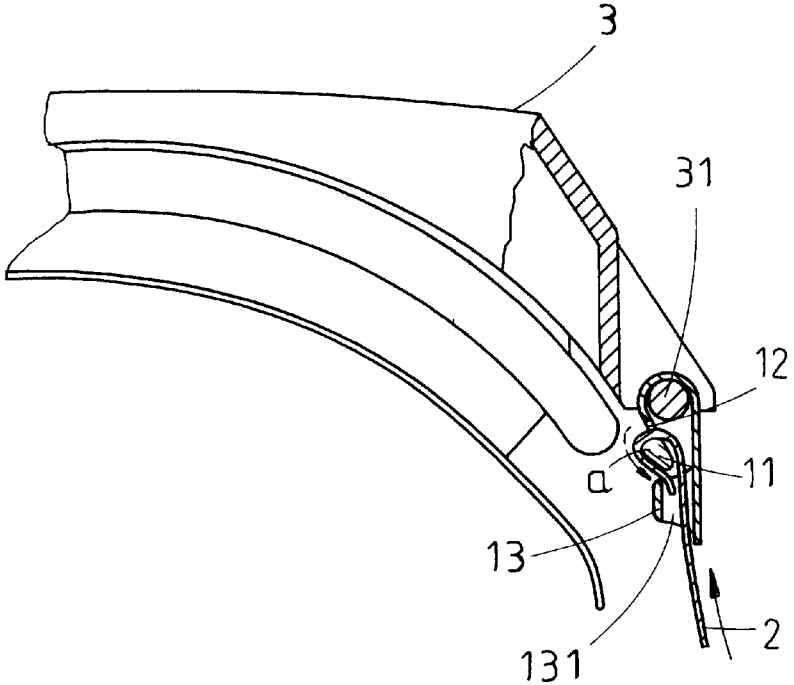
FIG. 2 is a partially sectioned side view of a portion of a pair of swimming goggles, illustrating assembly of a strap by the strap connector in FIG. 1.

In assembly, referring to FIG. 2, the second end 11 of the strap connector 1 is firstly bend around a positioning peg 31 of a goggle frame 3 to a position that faces the first end 13 of the strap connector 13. Then, an end of a strap 2 is extended through the longitudinal slot 131, the transverse slot 12, and again the longitudinal slot 131 in sequence, as indicated by the arrows in FIG. 2. Next, the user may pull the strap 2 to adjust the length of the strap 2. Then, the user may pull the strap 2 to a status shown in FIG. 3 to finish the connection of the strap 2. It is appreciated that the second end 11 is partially received in the longitudinal slot 131 of the first end 13, yet the wedge 111 has a maximum width that is greater than a width of the longitudinal slot 131 to reliably retain the wedge 111 in the first end 13. It is further appreciated that the strap 2 has a bent section "a" to retain the strap 2 in place without causing serious deformation of the strap 2. In addition, the bent section of the strap is received in a gap between the wedge 111 and the side walls that define the longitudinal slot.

Figure 4:
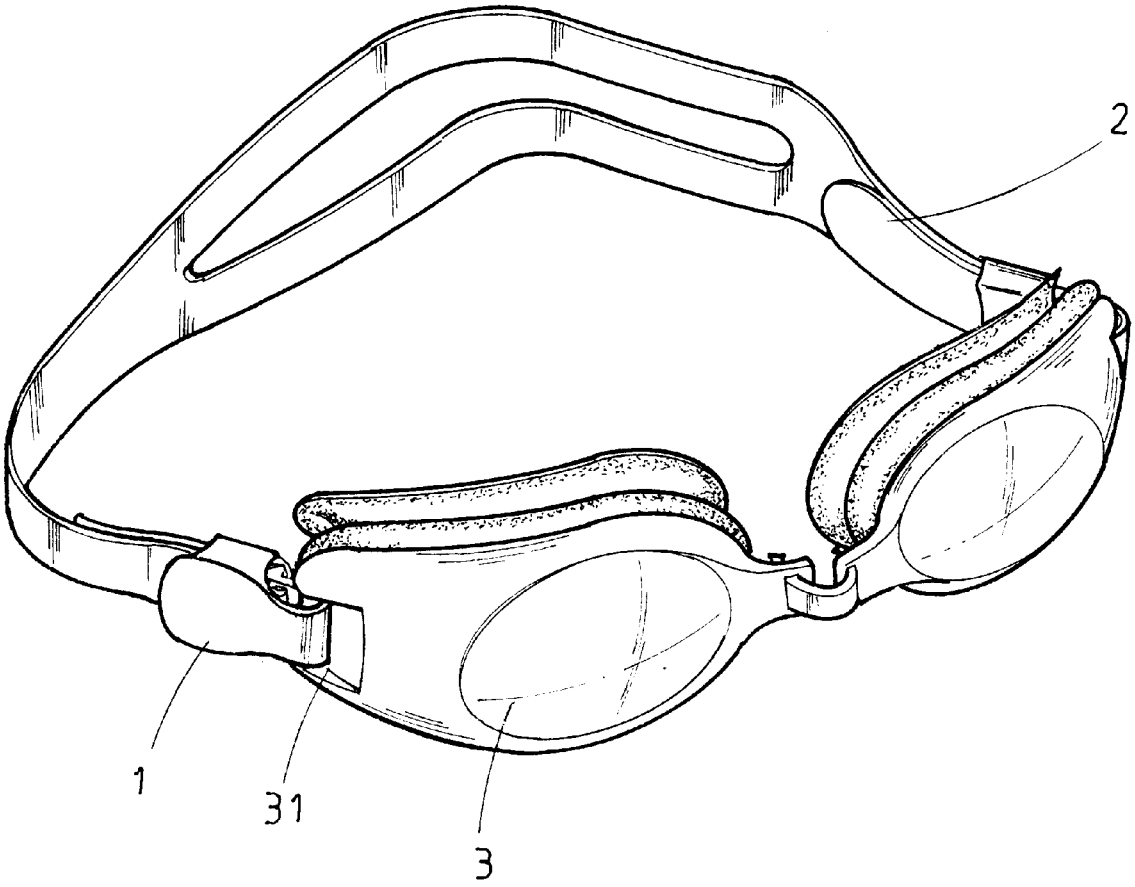
FIG. 4 is a perspective view of a pair of swimming goggles with strap connectors in accordance with the present invention.

Thus, the strap 2 can be easily yet securely connected to the goggle frame 3 without causing serious deformation of the strap 2. FIG. 4 illustrates a pair of swimming goggles with connecting straps in accordance with the present invention. It is appreciated that the strap 2 directly extends from the second end 13 of the strap connector and thus provides an aesthetic outline. When required, the user may apply a force to the second end 11 of the strap connector 1 to remove the second end 11 from the first end 131 to thereby allow re-adjustment of the length of the strap 2.

Figure 5:
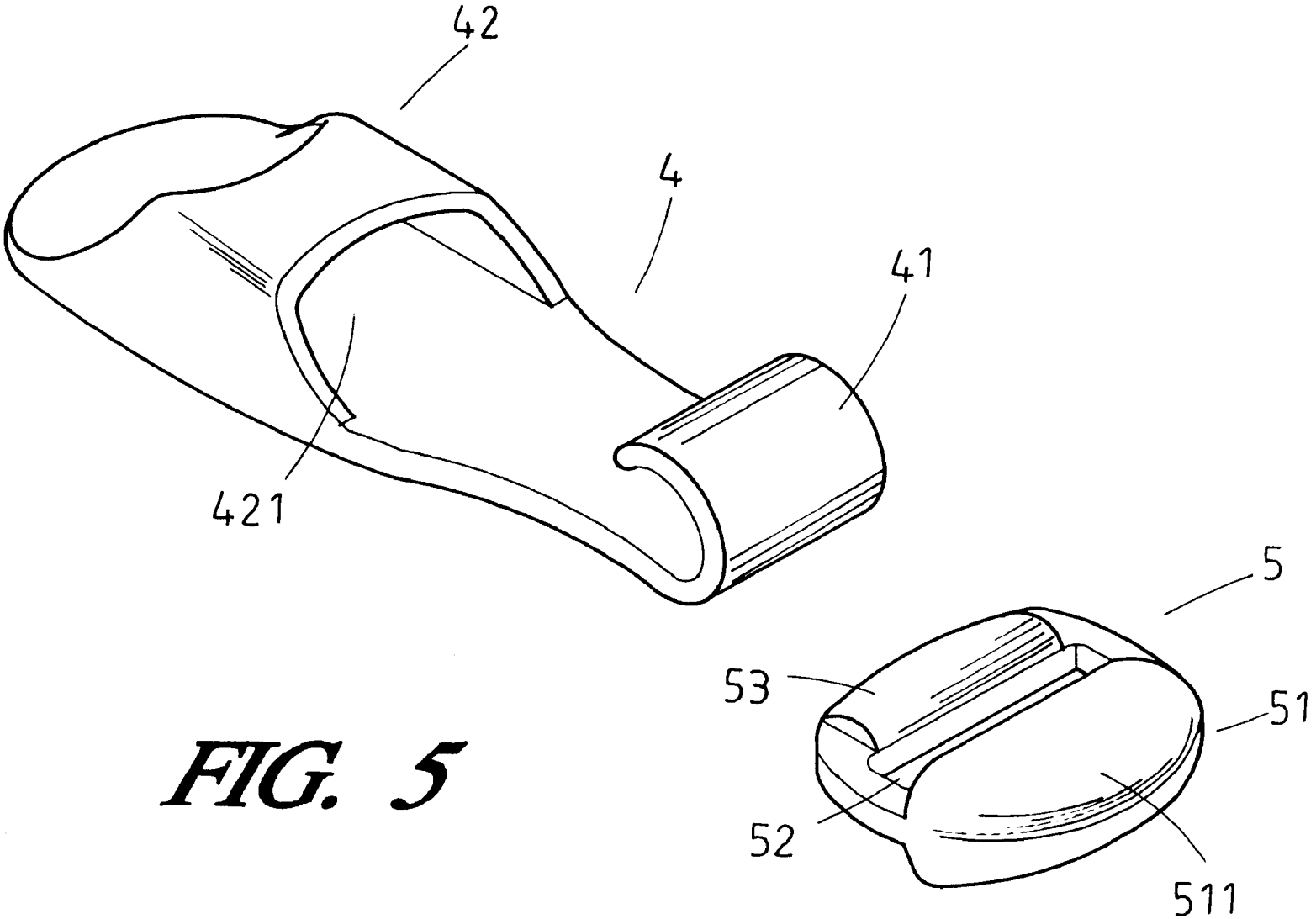
FIG. 5 is an exploded perspective view of a second embodiment of the strap connector in accordance with the present invention.

FIG. 5 illustrates a second embodiment of the strap connector in accordance with the present invention. In this embodiment, the strap connector includes a main body 4 and a retaining member 5. The main body 4 includes a first end 41 and a second 42 having a longitudinal slot 421. The retaining member 5 includes a first end 53, a second end 51 with a wedge 511 that tapers toward an end edge thereof, and a transverse slot 52 defined between the first end 53 and the second end 51.

Figure 6:
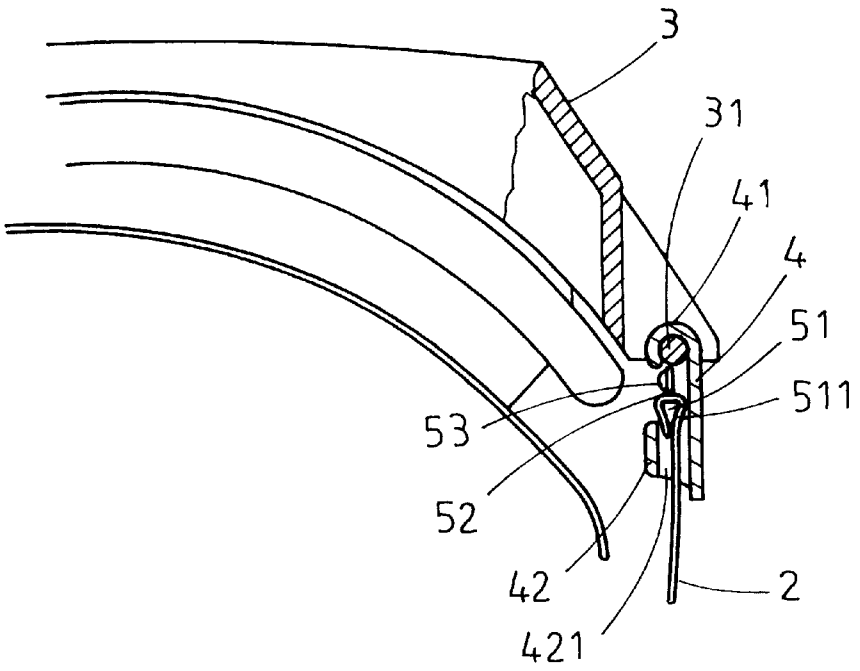
FIG. 6 is a partially sectioned side view of a portion of a pair of swimming goggles, illustrating assembly of a strap by the strap connector in FIG. 5.
Figure 7:
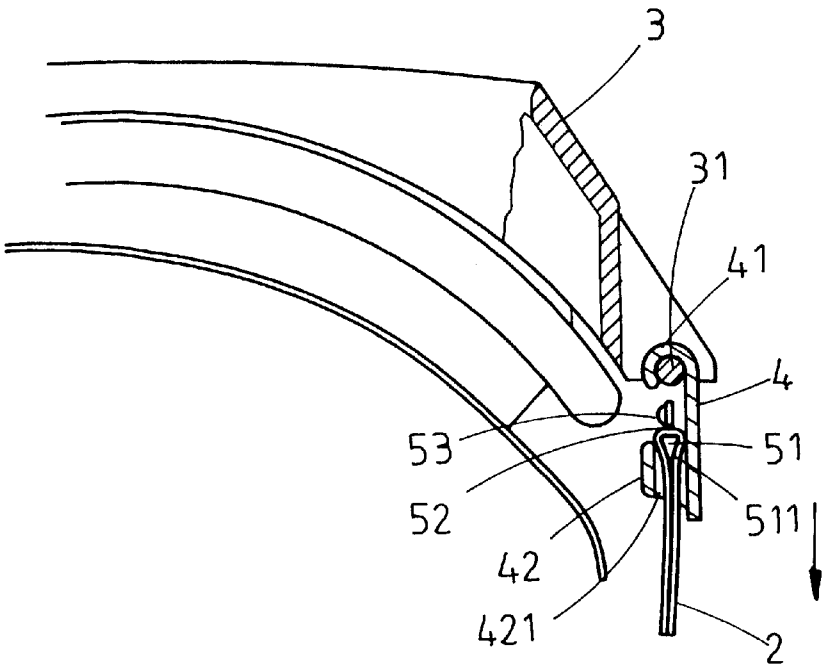
FIG. 7 is a partially sectioned side view similar to FIG. 6, illustrating the status of the strap after assembly.
Figure 8:
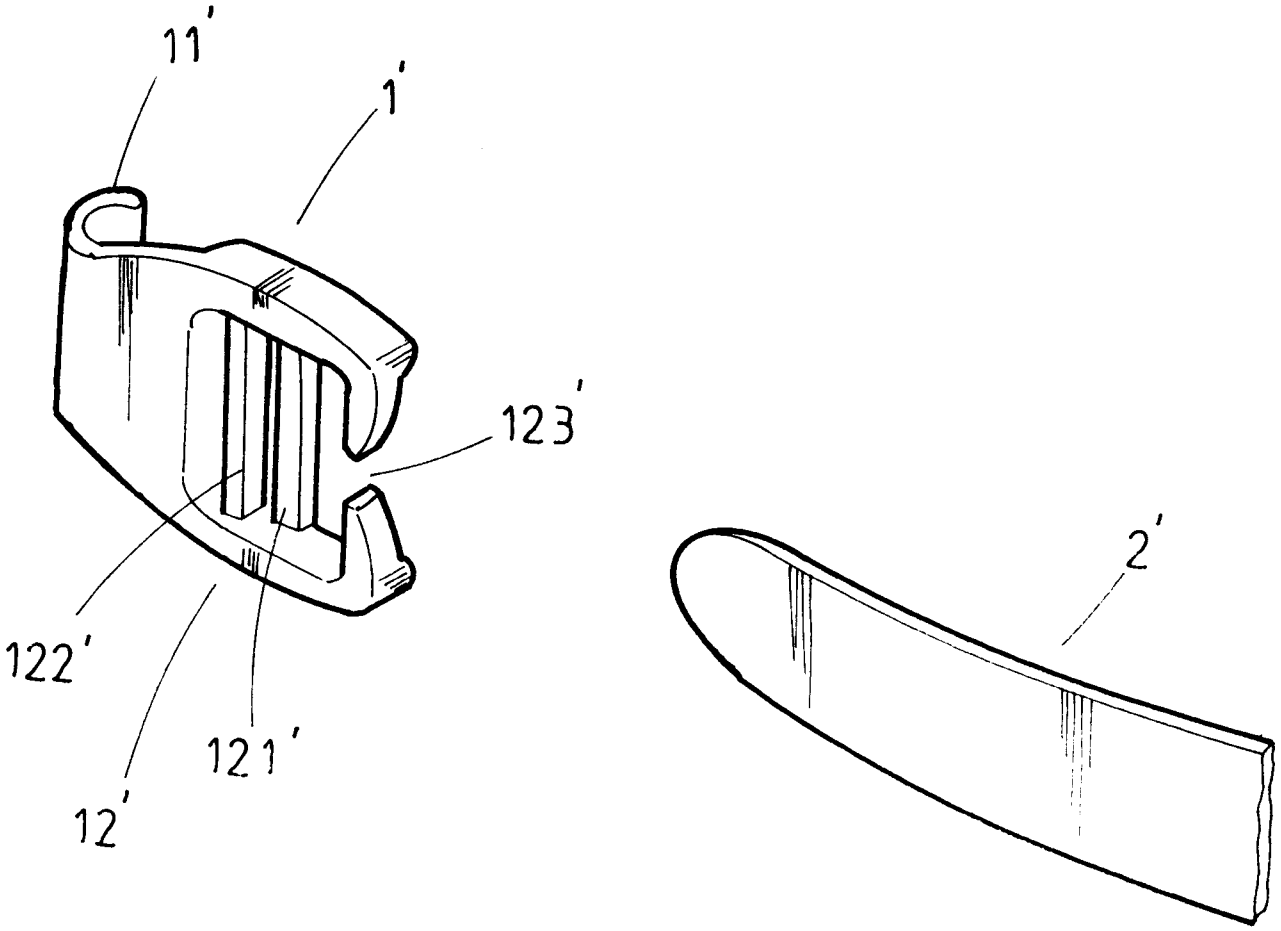
FIG. 8 PRIOR ART
FIG. 8 is an exploded view of a strap connector according to prior art.
Figure 10:
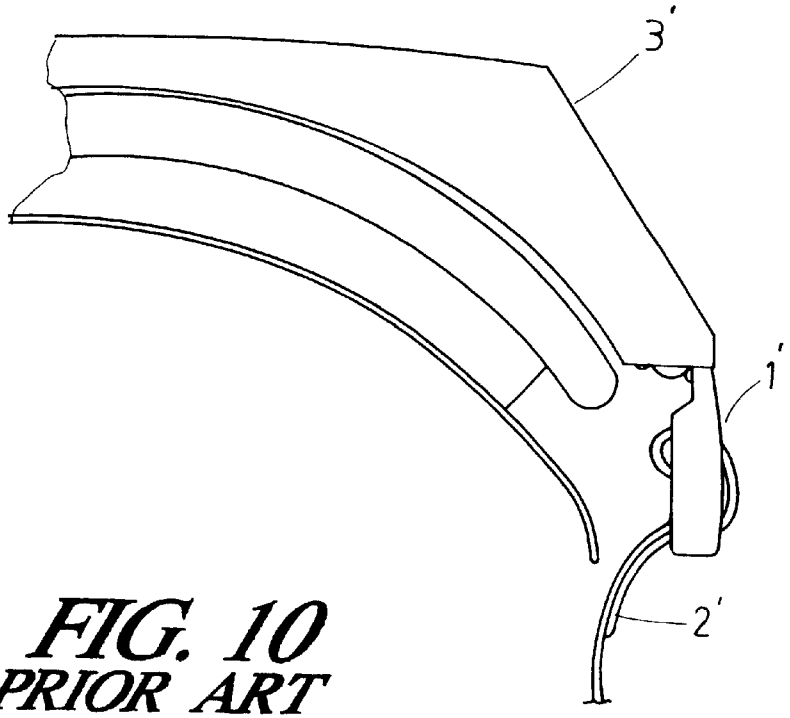
FIG. 10 PRIOR ART
FIG. 10 is a partially sectioned side view similar to FIG. 9, illustrating the status of the strap after assembly.
Figure 9:
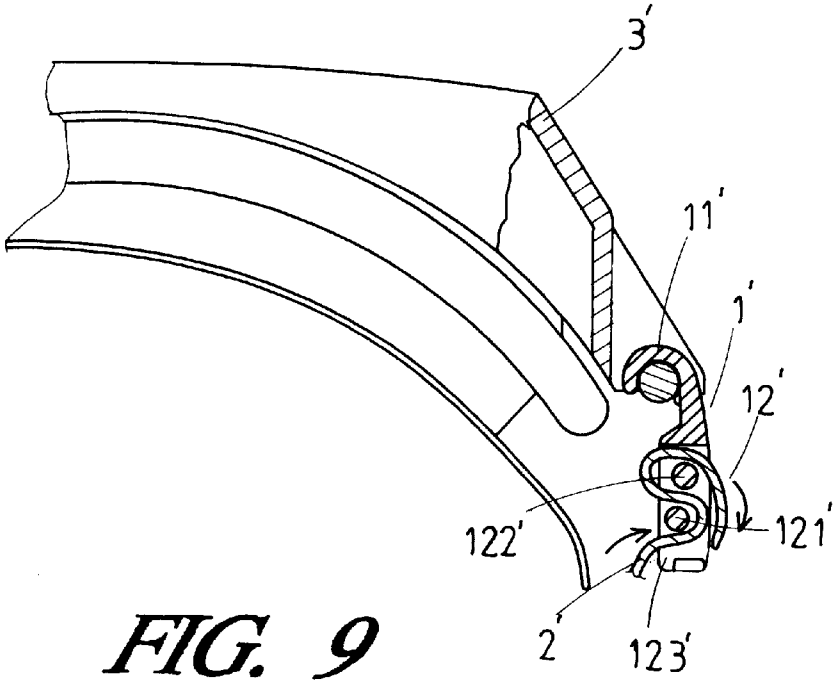
FIG. 9 PRIOR ART
FIG. 9 is a partially sectioned side view of a portion of a pair of conventional swimming goggles, illustrating assembly of a strap.
Figure 11:
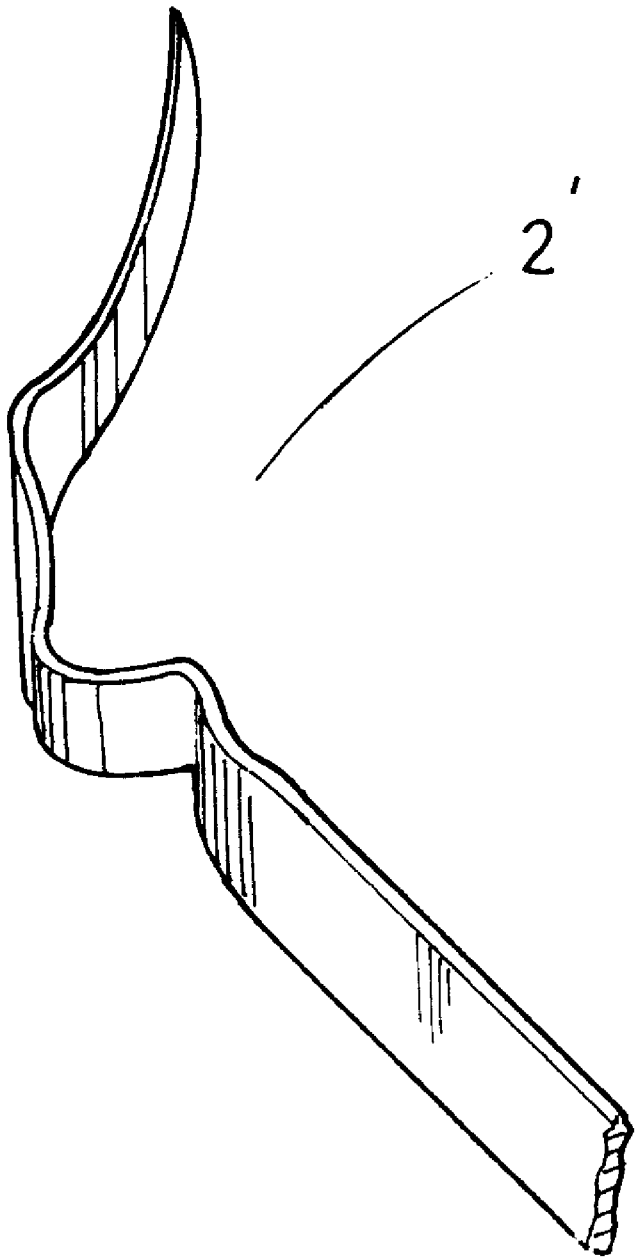
FIG. 11 PRIOR ART
FIG. 11 is a perspective view illustrating deformation of a conventional strap after use.

In assembly, referring to FIG. 6, the first end 41 of the main body 4 is connected to a positioning section 31 of the goggle frame 3 and the retaining member 5 is placed between the first end 41 and second end 42 of the main body 4, in which the wedge 511 faces the longitudinal slot 421. Then, an end of the strap 2 is extended from outside through the longitudinal slot 421, the transverse slot 52 of the retaining member 5, and again the longitudinal slot 421 in sequence, as shown in FIG. 6. Then, after adjusting the strap 2 to a desired length, the user may pull the strap 2 to a status shown in FIG. 7 to finish the connection of the strap 2. It is appreciated that the second end 51 of the retaining member 5 is partially received in the longitudinal slot 421 of the main body 4, yet the wedge 511 has a maximum width that is greater than a width of the longitudinal slot 421 to reliably retain the wedge 511 in the main body 4. Again, it is further appreciated that the strap 2 has a bent section to retain the strap 2 in place without causing serious deformation of the strap 2. In addition, the bent section of the strap 2 is received in a gap between the wedge 511 and the side walls that define the longitudinal slot 421.

Thus, the strap 2 can be easily yet securely connected to the goggle frame 3 without causing serious deformation of the strap 2. When required, the user may apply a force to the first end 53 of the retaining member 5 to remove the wedge 511 from the longitudinal slot 421 to thereby allow re-adjustment of the length of the strap 2.

According to the above description, it is appreciated that the strap connectors of the present invention may be easily connected to the goggle frame, instead of troublesome winding procedure in the conventional design. In addition, the re-adjustment of the length of the strap can be easily and quickly achieved by means of disengaging the wedge from the longitudinal slot, instead of troublesome unwinding of the strap from the strap connector. Furthermore, the strap is not twisted even after a long-term use, as the bent section of the strap is received in a gap between the wedge and the side walls that define the longitudinal slot. At last, after having been connected to the goggle frame, the strap together with the goggle frame may provide an aesthetic outline and comfortable wearing.

Although the invention has been explained in relation to its preferred embodiment, it is to be understood that many other possible modifications and variations can be made without departing from the spirit and scope of the invention as hereinafter claimed.

What is claimed is:

1. A strap connector for connecting a strap to a goggle frame, the strap connector comprising a first end having a longitudinal slot defined therein and a second end having a transverse slot defined therein, the second end further including a wedge that tapers toward an end edge thereof, the wedge having a maximum width greater than a width of the longitudinal slot, and the strap connector being bent so as to be connected to the goggle frame at a section between the first end thereof and the second end thereof, the wedge being partially received in the longitudinal slot of the strap connector, and the strap being wound through the longitudinal slot, the transverse slot, and the longitudinal slot in sequence.

2. A strap connector for connecting a strap to a goggle frame, the strap connector comprising a main body and a retaining member, the main body including a first end adapted to be connected to the goggle frame and a second having a longitudinal slot, the retaining member including a first end, a second end with a wedge that tapers toward an end edge thereof, and a transverse slot defined between the first end thereof and the second end thereof, the retaining member being mounted between the first end of the main body and the second end of the main body with the wedge partially received in the longitudinal slot, the wedge having a maximum width greater than a width of the longitudinal slot, and the strap being wound through the longitudinal slot, the transverse slot and the longitudinal slot in sequence.

3. The strap connector as claimed in claim 2, wherein the first end of the retaining member is operable to disengage the wedge from the longitudinal slot of the main body to allow adjustment of a length of the strap.

* * * * *